United States Patent [19]

Ata et al.

[11] Patent Number: 4,746,034

[45] Date of Patent: May 24, 1988

[54] PORTABLE LIQUID CONTAINER

[75] Inventors: Ali D. Ata, Chicago; Edward W. Olewinski, Stickney, both of Ill.

[73] Assignee: Nalco Chemical Company, Naperville, Ill.

[21] Appl. No.: 15,516

[22] Filed: Feb. 13, 1987

Related U.S. Application Data

[63] Continuation of Ser. No. 788,487, Oct. 17, 1985, abandoned.

[51] Int. Cl.[4] ..... B67D 5/60

[52] U.S. Cl. ..... 222/143; 222/185; 222/460; 220/1.5; 220/327; 141/364

[58] Field of Search ..... 141/363, 364, 382, 383, 141/279; 206/511, 512; 220/1.5, 327; 414/607, 608, 414; 222/143, 460, 185

[56] References Cited

U.S. PATENT DOCUMENTS

| | | | |
|---|---|---|---|
| 1,048,597 | 12/1912 | Shephard | 141/279 |
| 2,330,306 | 9/1943 | Murphy | 220/327 |
| 3,122,276 | 2/1964 | Andrae | 222/143 |
| 3,133,677 | 5/1964 | Bertels | 222/143 |
| 3,460,718 | 8/1969 | Plant | 222/143 |
| 3,571,533 | 3/1971 | Coleman | 206/511 |
| 3,785,534 | 1/1974 | Smith | 222/460 |

FOREIGN PATENT DOCUMENTS

| | | | |
|---|---|---|---|
| 1333605 | 6/1963 | France | 222/185 |

*Primary Examiner*—H. Grant Skaggs
*Attorney, Agent, or Firm*—Kinzer, Plyer, Dorn, McEachran & Jambor

[57] ABSTRACT

A portable liquid container has a four-sided shell enclosed by a bottom wall and a top wall. The bottom wall is formed by four triangular portions sloping downwardly to a delivery opening. The top wall has an upwardly sloping configuration with an enlarged opening in the middle thereof. The opening is normally covered by a lid. Two lifting channels and a delivery pipe and valve are located on the underside of the bottom wall. Four legs attached to the bottom wall support the container at a height sufficient to clear the delivery pipe and lifting channels. Leg positioners are located at the upper corners of the container and are arranged to receive the legs of a second like container stacked on top of a first container.

9 Claims, 3 Drawing Sheets

Fig. 1.
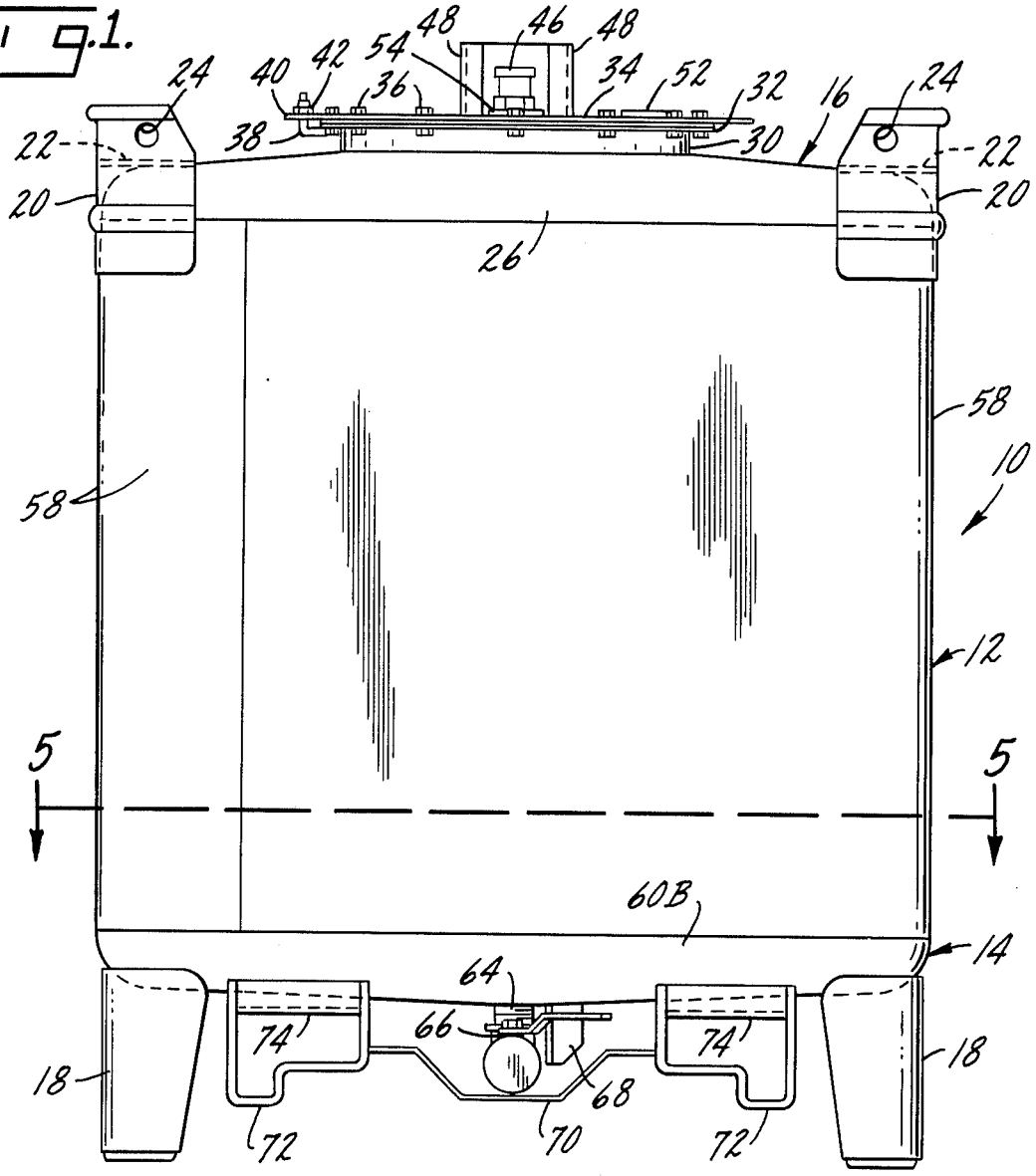
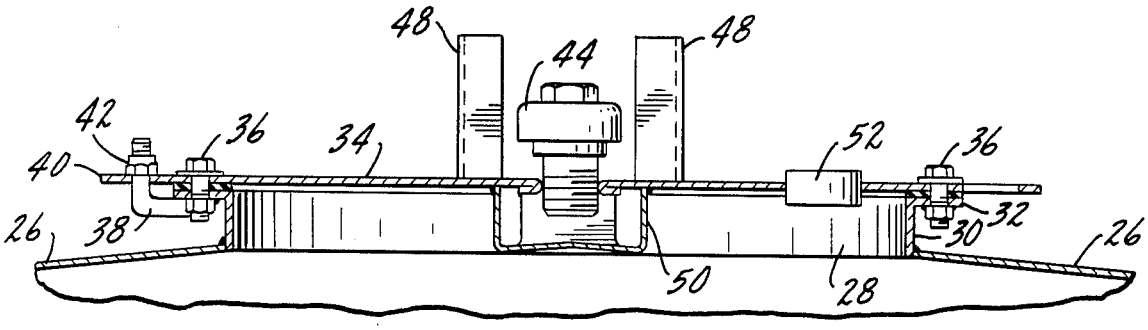
Fig. 4.

Fig. 5.
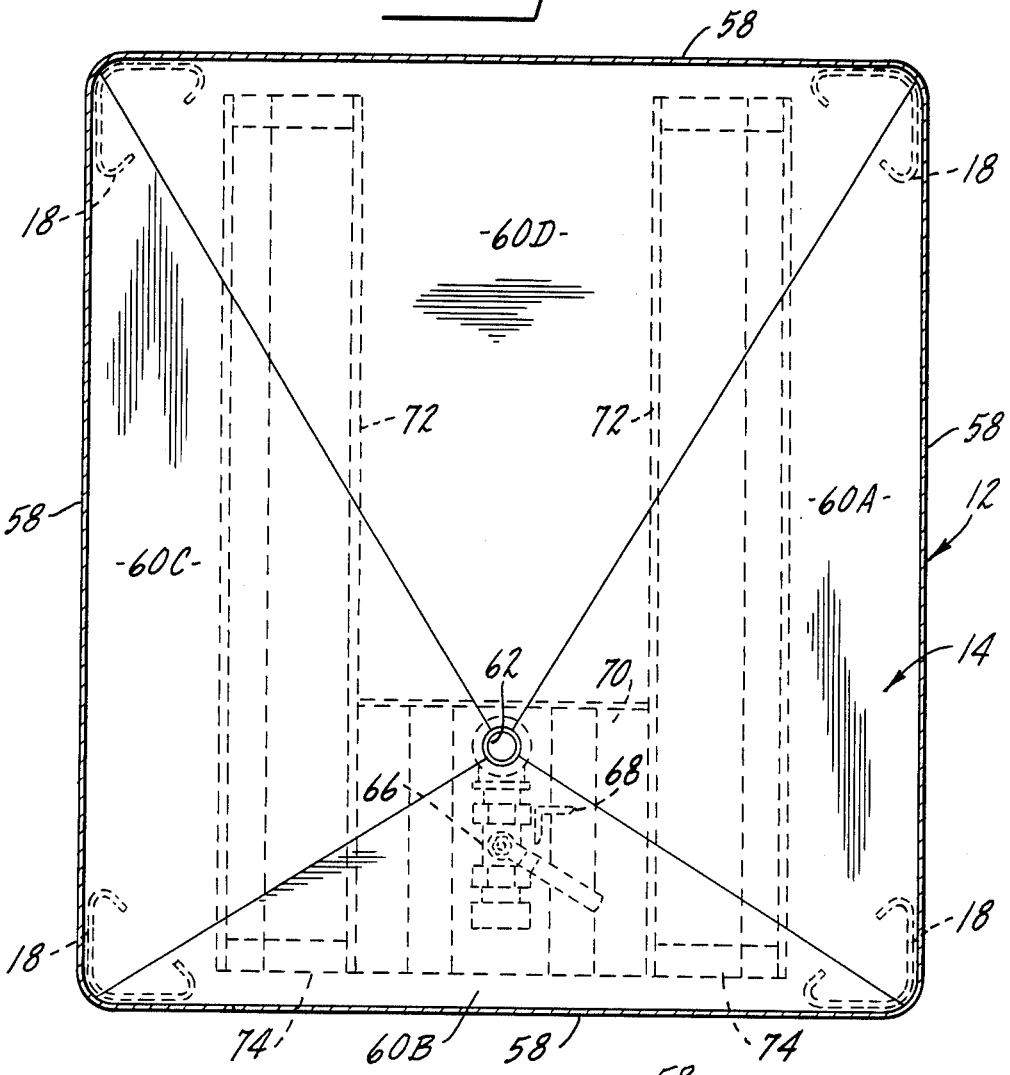
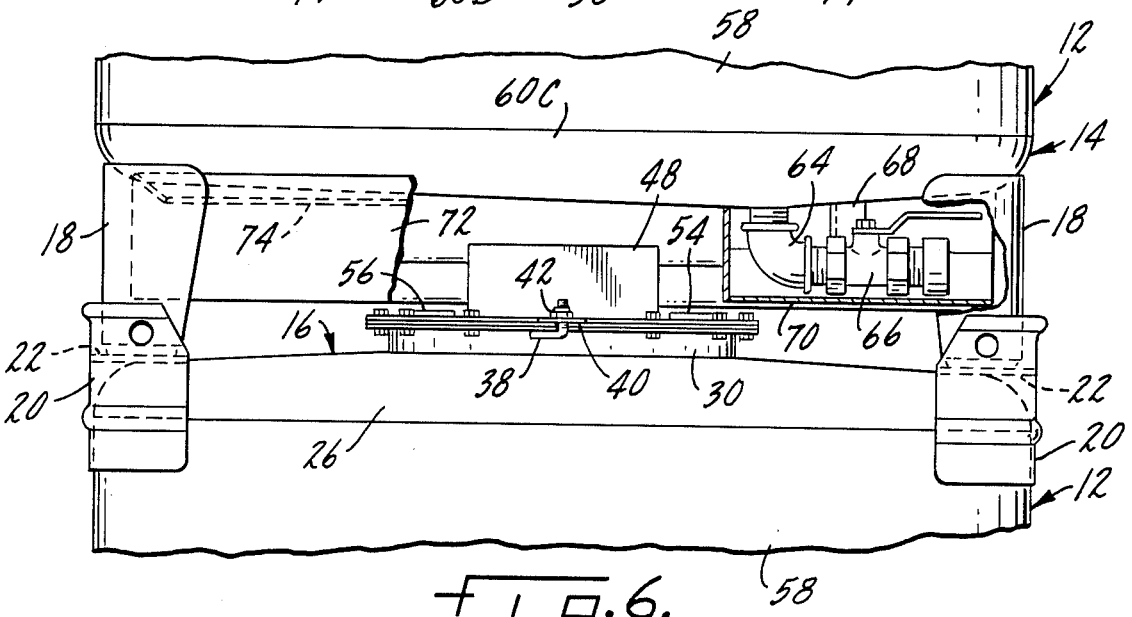
Fig. 6.

PORTABLE LIQUID CONTAINER

This is a continuation of co-pending application Ser. No. 788,487, filed on Oct. 17, 1985, now abandoned.

SUMMARY OF THE INVENTION

This invention relates to portable liquid containers and is particularly concerned with a reusable and stackable container for transporting, storing and dispensing liquid chemicals.

A primary object of the invention is to assure full drainage of the contents of a container without having to tilt or otherwise manipulate the container.

Another object of the invention is to enable the containers to be stacked or nested one atop another while providing fluid connections between the stacked containers.

A further object of the invention is to make provision for fork lift or crane manipulation of the container during transporting, stacking and cleaning.

Stil another object of the invention is to enable the container to be inverted in an elevated position by a fork lift or crane so that drainage of cleaning fluids can take place through a large opening which is uncovered when the lid is removed.

Still another object of the invention is to conserve on cost by hinging or otherwise connecting a removable lid to the top of the container to discourage indifference to losing or misplacing the lid.

Another object of the invention is to provide inexpensive, yet reliable, means for installing safety equipment on the container.

Other objects may appear from time to time in the following specification, drawings and claims.

BRIEF DESCRIPTION OF THE DRAWINGS

FIG. 1 is a side elevation view of the container.

FIG. 4 is a section taken along line 4—4 of FIG. 2.

FIG. 5 is a section taken along line 5—5 of FIG 1.

FIG. 6 is a side elevation view of adjoining portions of two stacked containers, showing the arrangements for nesting two containers together.

DETAILED DESCRIPTION OF THE INVENTION

Figure 2:
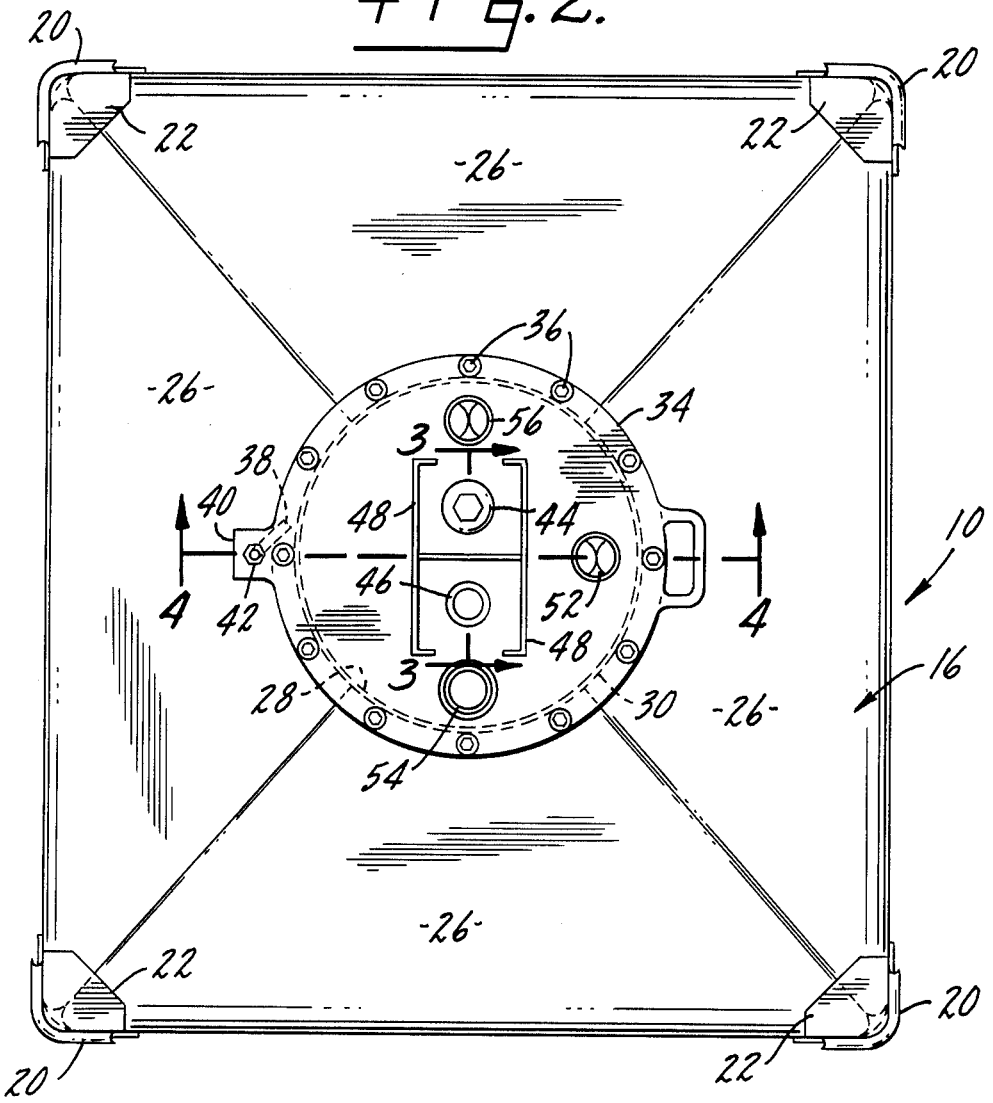
FIG. 2 is a plan view of the container.
Figure 3:
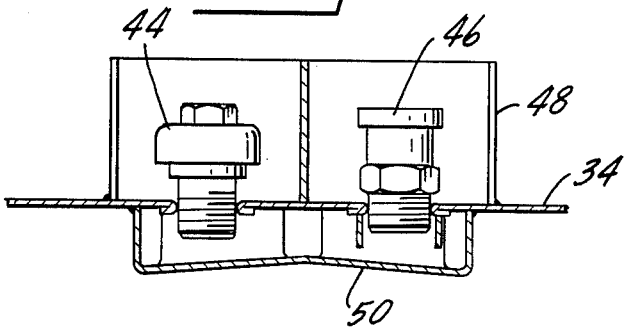
FIG. 3 is a section taken along line 3—3 of FIG. 2.

The container of the present invention is shown generally at 10 in FIG. 1. The container has a shell 12, a bottom wall 14 and a top wall 16, all preferably made of stainless steel. Four legs 18 are attached to the bottom wall 14 and extend sufficiently from the bottom wall to provide clearance for various apparatus attached to the bottom wall. Four leg positioners 20 are attached near the top of the container. In the embodiment shown, they are attached to about the intersection between the shell 12 and top wall 16. The leg positioners are arranged to receive and support the legs of a second like container stacked on top of a first container.

Looking at FIGS. 1–4, further details of the top wall 16 of the container will now be described. The leg positioners 20 include an angle bracket that fits around the corner of the shell and top wall. The bracket mounts a horizontal support plate 22. The legs of a stacked container rest on these plates, and the angle members prevent the stacked container from sliding about on the support plates. It will also be noted that the angle brackets have circular openings 24 which can be used for attaching hooks and the like so that the container can be manipulated by a crane.

Turning now to FIG. 2, the top wall 16 is a triangulated structure formed by four generally triangular panels 26. The panels slope upwardly from the shell 12 to an enlarged opening 28. The opening 28 is surrounded by a neck 30 which has a flange 32 as best seen in FIG. 4. The neck is preferably welded to the top wall panel members 26. The opening 28 is normally closed by a removable lid 34. A plurality of bolts 36 fasten the lid 34 to the flange 32. A gasket may be placed between the lid and flange. A special J-bolt 38 is welded to the underside of the flange 32 and extends upwardly through a tab 40 in the lid 34. A castle nut 42 is attached to the J-bolt 38 above the lid 34. The purpose of the J-bolt and castle nut is to discourage the permanent removal of the lid which often results in its being lost. Since it is intended that the container of the present invention will be reusable, this feature minimizes the costs associated with replacing lost lids.

The lid 34 has openings therein for a spring loaded vacuum breaker 44. There is also a pressure relief vent 46. The relief valve opens at 3 psig. The vacuum breaker 44 and relief vent 46 are protected on the exterior of the lid by a guard member 48 and on the interior by a splash guard 50.

There are three other openings in the lid 34. An opening 52 can be used as a fill opening when a lower container is receiving liquid from a stacked container on top of it. A second opening 54 has a fusible plug which melts in the event of a temperature rise in the container. A third opening 56 can be used for inspection or inserting a dip stick or similar purpose.

Turning now to FIGS. 1, 5 and 6, details of the shell 12 and bottom wall 14 will be described. The shell 12 is formed by four side walls 58 forming a generally rectangular container. The side walls are joined at rounded corners. The bottom wall 14 is a triangulated structure comprising four triangular portions 60A–D. The triangular portions adjoin one of the side walls 58 and slope downwardly to a delivery opening 62. This triangulated, sloping configuration assures that all liquid will drain from the container without having to tilt or otherwise manipulate the container. The delivery opening 62 communicates with a delivery pipe 64 underneath the bottom wall (FIG. 6). The delivery pipe 64 includes a ball valve 66. Discharge of liquid from the container is controlled by this valve. The delivery pipe is supported by a bracket 68 and protected by a shield 70.

Two elongated lifting channels 72 are attached to the underside of the bottom wall. The channel 72 extends below the shield 70 to provide additional protection to the shield and valve 66. Each channel includes a horizontal plate 74 attached to the sides of the bracket 72 (see FIG. 1). The plates 74 provide a lifting surface for the forks of a fork lift truck. The plates 74 are provided so the forks of the truck do not contact the angled portions of the bottom wall 14. The channels also allow the container to be suspended in an inverted position by a fork lift truck. This is advantageous when recycling a container. It must be washed before it can be reused. To accomplish this, the lid 34 is removed from the enlarged opening 28 which allows cleaning equipment to be easily inserted into the container from the bottom side when the container is inverted. Cleaning fluids are sprayed into the container and easily drain out through the enlarged opening. Since the top wall 16 is sloped toward the opening 28, the fluids will fully drain from the container. Also, the enlarged opening allows sufficient drainage that the cleaning fluids will not build up in the container and prevent complete washing of the container surfaces.

It will be noted that the delivery opening 62 is offset from center of the bottom wall. It is also offset from the fill opening 52 of an adjacent container. This serves at least two purposes. One, it locates the ball valve 66 closer to the side edge of the container so operating the valve is more convenient. Also, it facilitates fluid connections to the valve 66. A special fitting and hose is used to connect the valve to a fill opening 52 of an adjacent container. A connecting hose is shown at 76 in FIG. 7.

Figure 7:
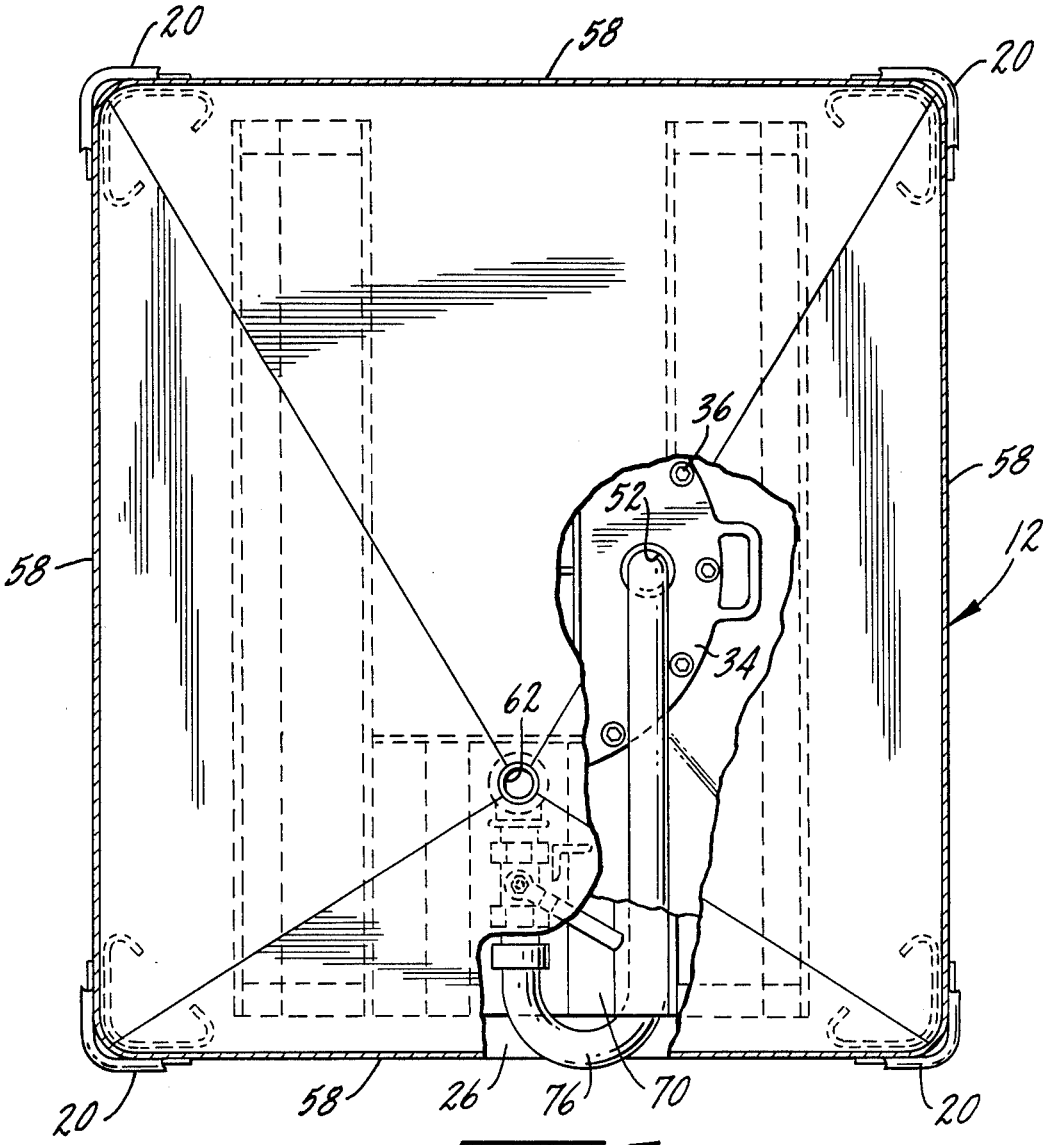
FIG. 7 is a view of two stacked containers taken along line 7—7 of FIG. 6, with portions broken away.

As seen in FIGS. 6 and 7, the containers are stackable. The legs 18 of an upper container nest in the leg positioners 20 of a lower container. This arrangement allows the use of a base unit and a recyclable top unit. It also results in a saving in warehouse space. When the containers are full, they can be stacked three units high. Fluid connections can be made between the stacked containers in the manner described above. With this arrangement, the feed to a process utilizing the liquid can be from the bottom unit. When an upper unit is empty, it is removed and returned for cleaning and refill. The bottom unit continues to supply liquid to the process while a new top unit is being put in place.

Whereas a preferred form of the invention has been shown and described, it will be realized that modifications may be made thereto without departing from the scope of the following claims.

We claim:

1. A portable, stackable container for liquids, constituting a first container on which a second like container may be stacked, comprising:

a shell having four side walls of stainless steel in a generally rectangular configuration;

a stainless steel bottom wall closing the bottom of the shell and including triangular portions with the apex thereof displaced considerably nearer one side of the bottom wall than the opposed side, each triangular portion having a base adjoining a side wall and sloping downwardly, and a delivery opening at the apex of the bottom wall triangulation to assure complete drainage of liquid;

a delivery hose underneath the bottom wall, including a valve connected to the delivery opening in association therewith, access to the valve being facilitated by the closer position of the delivery opening aforesaid;

a stainless steel top wall enclosing the side walls of the shell and sloping upwardly to meet an enlarged opening which is normally closed by a removable lid, removal of the lid allowing cleaning equipment to be inserted through the enlarged opening and cleaning fluids to be drained therefrom upon inversion of the container, said lid having a filling opening, which filling opening is offset from the delivery opening and positioned nearer one side of the top wall than the opposed side to facilitate connection of said hose to the filling opening of a like, second container also having a delivery opening in the bottom wall offset from a filling opening in the top wall;

two elongated fork lift channels attached to the underside of the bottom well, each channel including a horizontal top plate which is spaced in protecting relation from the bottom wall to provide a lifting surface for the forks of a lift truck beneath the bottom wall while the channels allow for transporting, inversion and cleaning of the container when supported by a fork lift;

a plurality of bottom legs adjacent the four corners of the shell and extending downwardly therefrom to support the container;

a plurality of upwardly opening leg positioners, one for each leg, near the top of the container and also positioned at the corners of the shell to receive the legs of a second like container stacked thereon; and horizontal support plates mounted to said leg positioners for supporting the legs of the second container without engagement between the legs and the top wall of the container therebeneath.

2. A container according to claim 1 wherein the lid has one opening therein mounting a vacuum breaker and a second opening therein mounting a pressure relief valve, the length of the legs being such that when positioned on the support plates of a like, second container therebeneath the bottom wall of the second container is spaced above the vacuum breaker and relief valve of the first container; and a first shield surrounding the relief valve and vacuum breaker of the first container, with a second shield surrounding the valve associated with said delivery opening.

3. A container according to claim 2 wherein the fork lift channels are on opposite sides of said shield for said associated valve to provide further protection for said associated valve.

4. A container according to claim 2 in which the shell has four rounded corners along its length, in which the legs and leg positioners are separately attached to the shell adjacent the corners, and in which the leg positioners are wrapped about the corners.

5. A container according to claim 1 constituting a first container arranged in a system with a second, like container having its legs positioned in the leg positioners of the first container, with a hose in fluid connection between the valve associated with the outlet opening of the second container and the inlet opening of the first container therebeneath, the outlet opening being positioned nearer one side of the bottom wall of the second container than the opposed side facilitating access to the valve at said nearer side, and the inlet opening of the first container being positioned nearer one side of the top wall of the first container than the opposed side, facilitating connection of the hose between the outlet and inlet openings.

6. A dispensing system for providing an uninterrupted supply of liquid to a supplied device, comprising:

a lower liquid container having a delivery opening which is adapted to be connected to the supplied device;

an upper liquid container stackable on top of the lower container and in fluid communication therewith to replenish the supply of liquid in the lower container whereupon the upper container itself is removable and can be replaced with a like, full upper container during which time the supplied device continues to receive liquid from the lower container;

each container being of stainless steel having a top wall, four side walls in a rectangular shell configuration, and a bottom wall;

a plurality of dependent bottom legs on each container with the bottom legs attached to the shell adjacent the corners at the bottom of the shell, and of such length as to position the upper container bottom wall and the lower container top wall of stacked containers is spaced relation, each container having leg positioner brackets at the four rounded corners adjacent the top thereof whereby the legs of the upper container are fitted into the leg positioners of the lower container, and horizontal support plates mounted to said leg positioners of the lower container with the legs of the upper container engaging said horizontal support plates without engaging the top wall of the lower container;

each container having a delivery opening in its bottom wall offset from the vertical axis of the container in a first angular position relative to that axis, each container having a fill opening in its top wall offset from the vertical axis of the container in a second angular position relative to that axis such that the fill opening and delivery opening are axially displaced thereby enabling a fluid connection to be completed between the delivery opening of the upper container and the fill opening of the lower container within the spaced relation aforesaid;

the bottom wall of each container being formed of downwardly sloping triangular portions which meet at the delivery opening to assure complete drainage of the shell contents and the top wall having upwardly sloped triangular portions meeting at an enlarged opening into which washing equipment may be inserted, the triangulated top wall allowing complete drainage, when the interior of the shell is washed, upon inverting the container by a fork lift;

fork lift channels attached to the underside of the containers, between the legs, and configured to allow the container to be lifted, tilted and inverted; and means providing fluid communication between the delivery opening of the upper container and the fill opening of the lower container.

7. A dispensing system according to claim 6 in which the corners of each shell are rounded for the length thereof, the legs and leg positioners being separate and separately attached at the four corners of the shell in alignment with the longitudinal axes of the four rounded corners of the shell.

8. A container system according to claim 6 wherein the lid of each container has one opening therein mounting a vacuum breaker and a second opening mounting a pressure relief valve, combined with a shield thereabout, all disposed within the spaced relation aforesaid when the containers are stacked.

9. A container system according to claim 6 wherein the connecting means includes a delivery valve, a covering shield to protect the delivery valve, and wherein the fork lift channels are on opposite sides of said covering shield to provide further protection for the delivery valve.

* * * * *

UNITED STATES PATENT AND TRADEMARK OFFICE

CERTIFICATE OF CORRECTION

PATENT NO. : 4,746,034

DATED : May 24, 1988

INVENTOR(S) : Ali D. Ata and Edward W. Olewinski

It is certified that error appears in the above—identified patent and that said Letters Patent is hereby corrected as shown below:

Claim 1, column 4, line 2, change "well" to --wall--;

Claim 6, column 5, line 9, change "is" to --in--.

Signed and Sealed this

Eighth Day of November, 1988

*Attest:*

DONALD J. QUIGG

*Attesting Officer*

*Commissioner of Patents and Trademarks*